US010711488B2

(12) United States Patent
Tabib et al.

(10) Patent No.: US 10,711,488 B2
(45) Date of Patent: Jul. 14, 2020

(54) ELECTRIC DOOR LOCK CONTROLLER AND MONITORING SYSTEM AND METHOD OF USE

(71) Applicants: Isac Tabib, White Plains, NY (US); Mohammad Mehdi Daryadel, Sanford, FL (US)

(72) Inventors: Isac Tabib, White Plains, NY (US); Mohammad Mehdi Daryadel, Sanford, FL (US)

( * ) Notice: Subject to any disclaimer, the term of this patent is extended or adjusted under 35 U.S.C. 154(b) by 0 days.

(21) Appl. No.: 16/181,597

(22) Filed: Nov. 6, 2018

(65) Prior Publication Data

US 2019/0368227 A1 Dec. 5, 2019

Related U.S. Application Data

(60) Provisional application No. 62/681,069, filed on Jun. 5, 2018.

(51) Int. Cl.

| | |
|---|---|
| ***E05B 45/06*** | (2006.01) |
| ***E05B 17/22*** | (2006.01) |
| ***E05B 65/10*** | (2006.01) |
| ***G08B 13/06*** | (2006.01) |
| ***G07C 9/28*** | (2020.01) |

(52) U.S. Cl.

CPC ..... *E05B 45/06* (2013.01); *E05B 17/226* (2013.01); *E05B 65/108* (2013.01); *G07C 9/28* (2020.01); *G08B 13/06* (2013.01); *E05Y 2900/132* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,489,065 | B2 | 7/2013 | Green et al. | |
| 2003/0231102 | A1* | 12/2003 | Fisher | G07C 9/00103 340/5.73 |
| 2010/0324817 | A1* | 12/2010 | Hansen | G01C 21/3415 701/414 |
| 2011/0169604 | A1* | 7/2011 | Ghabra | G07C 9/00309 340/5.71 |
| 2017/0140589 | A1* | 5/2017 | Bender | G07C 9/00309 |
| 2018/0075679 | A1* | 3/2018 | Niroomand | E05B 47/026 |

* cited by examiner

*Primary Examiner* — Nabil H Syed
*Assistant Examiner* — Cal J Eustaquio
(74) *Attorney, Agent, or Firm* — Forge IP, PLLC

(57) ABSTRACT

An electric door lock and monitoring system and method of use provides for intelligent control of a door lock, including fire alarm control and monitoring. The system employs location-based rules to facilitate code compliance, such that the system controls the door lock at least in part based on a selected subset of the location-based rules data, the subset of location-based rules data being automatically selected by the processor at least in part based on data indicative of a geographic location of the electronic door lock. The system, also employs spoken word alarms increase in frequency and/or in sound pitch over time to portray increased urgency.

14 Claims, 14 Drawing Sheets

ELECTRIC DOOR LOCK CONTROLLER AND MONITORING SYSTEM AND METHOD OF USE

FIELD OF THE INVENTION

The present invention relates generally to the field of signaling and more specifically relates to alarm systems in which the location of the alarm condition is signaled to a central station

BACKGROUND OF THE INVENTION

Electric door lock and monitoring systems are commonly used for many applications, including access security as well as fire safety alarm events. As sophistication grows in the form of advanced hardware and software, control and management of electric door lock and monitoring systems improves. To date, many advances have been implemented, including programmable control via both wireless and wired communication.

Existing electric door lock and monitoring systems control system access, alarm signaling, and fire alarm unlocking, yet lack intelligent control and advanced user access programmability. Various attempts have been made to solve problems found in electric door lock and monitoring systems. Among these are found in: U.S. Pat. No. 8,489,065 to Green, et. al., who disclosed a method for using any mobile device to manage a security system in retail environments in which an application or applet is installed on the mobile device providing a GUI for users to easily perform functions allowable by the security system. This method can be added to any legacy security system providing remote control and monitoring of the system via two-way communication links. Methods for processing touch inputs on mobile devices for security management are disclosed, including reading data from a multipoint sensing device such as a multipoint touchscreen, and identifying at least one multipoint gesture based on data from the multipoint sensing device. These functions provide vast improvements in retail security by providing store personnel earliest possible theft detection, higher level theft prevention than previously possible, communication between mobile devices in security systems, and evidence provided to law enforcement faster than ever possible.

Advances in communication enable native RS-485 wired connection to an electric door lock controller as a means for feeding back data measurement information and feeding forward control signals. Existing RS-485 connection schemes enable communication among a host of devices. Software applications communicated over Ethernet, WiFi, and Bluetooth expand control beyond dedicated instruments to smart phones, computers, and tablets. There exists a need for improved electric door lock programming, setup, and monitoring capability through the incorporation of advanced communications, control, and programming methods.

None of the above inventions and patents, taken either singly or in combination, is seen to describe the invention as claimed. Thus, a need exists for an intelligent electric door lock and monitoring system.

SUMMARY OF THE INVENTION

The present invention advantageously fills the aforementioned deficiencies by providing an electric door lock and monitoring system and method. The present invention is superior to other systems in that it effectively is configured with features that enhance installation setup and minimize installation duration, increase functionality, monitoring and versatility; extends communication capability to wired Ethernet, and wireless WiFi and Bluetooth; and offers extended control and monitoring of electric door locks via an interactive graphical LCD display and Bluetooth connected mobile device App, and via a remote web page. Collectively, these enhancements and features provide for easy remote programmability while located away from the door lock installation site, as well as onsite, thus minimizing ongoing support costs. Advantages include: shorter response time by simply executing a command via a communication protocol, such as Bluetooth, in combination with an App, WiFi or Ethernet in combination with a web page or control signals, or Open Supervised Device Protocol (OSDP) RS-485 communication. Key Fob/iButton touch and Wiegand wireless card reader capability, together in functional combination with an internal database, manage users' access rights. The electric door lock controller and monitoring system offers the advantage of onboard data management and storage records of users, alarm incidents, and door lock events and status.

The electric door lock controller and monitoring system is designed to manage any free egress emergency exit perimeter door or protected areas and alarm the door in accordance with life safety code requirements while maintaining the building's security. The electric door lock controller and monitoring system is suited for use in any building that requires securing, monitoring, and/or alarming security doors.

Installers and administrators can program the electric door lock controller and monitoring system as well as change configuration, timers, functionality, displayed screen information, and add or delete user's digital key fob information without the need to remove the unit off the wall. Programming is via Bluetooth signaling, together in functional combination with a software application (App), and several combinations of web page software communication, via RS-485, wired and wireless Ethernet. Door access is expanded to key Fobs using iButton touch or a Wiegand wireless card reader onsite at the electric door lock and monitoring system location. Additionally, remote monitoring and management of the electric door lock controller and monitoring system is done from any stand-alone guard station or via interface to the building's access control system. The electric door lock controller and monitoring system operates from 12 v/24 v DC sources or Power over Ethernet (PoE). The electric door lock controller and monitoring system has 6 control inputs and 4 programmable form C relay outputs. Additional novelty includes an integrated user selectable End of Line (EOL) supervision resistor configuration, thus eliminating the need for additional wiring with in-line resistors.

Novelty extends to an interactive graphical LCD display that presents a plurality of screens that show a door is secured, authorized exit mode, door pre-alarm with displayed timer countdown, door in alarm with displayed timer countdown, door held open with displayed timer countdown, and a screen indicating when the electronic door lock controller and system is in programming mode. In addition to the door's status the display also provides information including user programmable header text such as "Loading Dock", footer text—such as www.mycompany.com, and any three lines of text to display information, such as company name, branch, floor location or other relevant information. Graphical images, such as a company logo, can be incorporated as display background. Further display screens present information on timers, such as the condition's count up/down timer and diagnostics, such as inputs and outputs active/inactive status. Similar informative screens are displayed on a mobile device using the software App and via web page software.

Programmable timers provide a means for egress and alarm timing. Timers can be set for any duration of nuisance times or durations of 0, 1, or 2 seconds based on local code. Mobile device GPS intelligence together in functional combination with the App software recognizes the location of the electric door lock monitor and system then automatically overrides the timing of the Nuisance Delay time period to 0, 1, or 2 seconds to match local code. In addition to the on board iButton and Wiegand card reader, the unit responds to lock/unlock and other command from a Mobile device via wireless mechanisms such as Bluetooth, WiFi etc. Other timers include Bypass, Door Held, and Warning conditions and a shunt timer. Bypass timers can be programmed in increments of year, month, day, time in order to allow access for situations such as deliveries. The shunt timer programs the amount of time for shunting the door alarm. Door held timers are user selectable to establish the amount of time the door is held open. Warning timers are programmable count down timers that produce an audible alarm sounding for the duration of the programmed alarm period.

Novel features also include a programmable audio status report in spoken words. For example, the electric door lock controller and monitoring system can speak an audible spoken alarm of "Please wait, door will unlock in x seconds . . . " in any language and compliance with "Special Locking" provisions. The electronic door lock controller and monitoring system includes a built-in Fire Alarm monitoring/action port and an audible variable pitch/pulse to denote "time to unlock urgency . . . " that is coordinated with a visual count down screen presented on the interactive graphical LCD display to alert users of entry time windows. The electric door lock controller and system also has a Tamper sensor and tamper alert feature for local and remote signaling to notify monitoring stations when the electric door lock controller is removed from its mounting location.

The figures which accompany the written portion of this specification illustrate embodiments and method(s) of use for the present invention, an electric door lock controller and monitoring system, constructed and operative according to the teachings of the present invention.

DETAILED DESCRIPTION OF THE INVENTION

Figure 1:
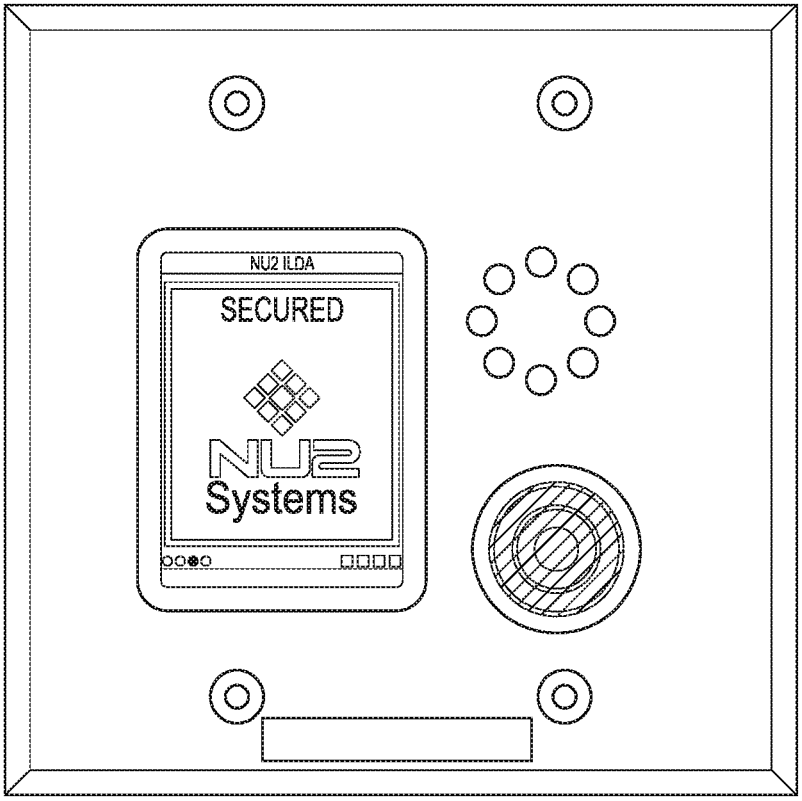
FIG. 1 is a perspective view of an electric door lock controller and monitoring system according to an embodiment of the present invention.

The various embodiments of the present invention will hereinafter be described in conjunction with the appended drawings, wherein like designations denote like elements.

The present invention is directed to an electric door lock controller and monitoring system and method of use to manage special locking arrangements of emergency doors, including delayed egress, provide status and control of local and remote alarms, manage functionality, monitor functions, signal door and alarm status audibly as well as visually, provide monitoring and programmability via an interactive graphical interface LCD user interface, Bluetooth connected App, and/or remote web page, and communicate status messaging.

The electric door lock controller receives signal alerts by remote supervisory stations via any electronic means, including but not limited to, input connectors, Open Supervised Device Protocol (OSDP) RS-485 communication, Ethernet, WiFi, or Bluetooth protocols. The electric door lock controller responds to lock/unlock and other commands from an iButton, Wiegand card reader, mobile device or remote supervisory station, or via wired or wireless ethernet. The management capabilities include: ADD USER iButton for adding new user access to a stored data base. The iButton is then used as a touch security trigger that activates the electric door lock controller to open an adjacent door. Other forms of access signaling include a wireless Wiegand card reader or biometric sensor identification reader linking.

Programmability and monitoring functions are via the App or web page software and an interactive graphical interface LCD display. Programmability includes configuring the settings of processes labeled Output Configuration that sets the status of four onboard relays and an Input Configuration programming system setup for initializing door lock functions. Other programmable functions include General Alarm configuration settings management of time durations, Tamper sensor activation/deactivation, activation settings for door alarms, and door bypass or door shunt conditions.

An internal database within the programmable microprocessor controller manages user's access rights while an internal memory stores access information, user access information, electric lock usage, and alarm events. The programmable microprocessor controller is equipped with built in OSDP compliant RS-485 port allowing for controllers to also communicate with other door alarm controllers, with Smart Power Supplies, with Universal Interface Boards, with Multi door access controllers, and any other OEM electronic devices utilizing the OSDP protocol. The programmable microprocessor controller works together in functional combination with a proprietary software program having mobile App software interface capability, web page control and monitoring interface capability, and local programming interface capability including iButton reader control and signaling capability and Wiegand card reader capability, biometric identification sensor reading capability, and interactive graphical display LCD display input control and signaling capability. In addition, the programmable microprocessor controller has the ability to convert an RS-485 protocol signals into 10/100 Ethernet protocol and is able to interface with RS-485 devices via the T3M connector.

The electric door lock controller and monitoring system is capable of providing audio status in terms of spoken commands or alarms. The audio alarms have specific countdown combinations of pulse and frequency for varying sound pitch. As the timer descends, the pulses occur at increase frequencies as a method of portraying heightened urgency. The alarm countdown times are displayed on a screen in numeric representations of remaining seconds as well as an outer ring displayed image that encircles the numeric display. The outer ring display includes red and green segments that change colors as the system counts down.

A GPS link within the smart phone Application software automatically enables Nuisance Delay timing to match local code (such as 0 seconds for certain geographical regions, 1 second for other geographical regions, 2 seconds for yet other geographical regions).

Integrated End of Line (EOL) 1k and 1k/2k selections resistor configurations via the End of Line (EOL) 1k and 1k/2k jumper selector eliminate the need for inserting external resistors therefore providing the advantage of on-board setting during the initial install as well as during future configurations. The proprietary software enables compliance with "Special Locking" conditions.

An interactive graphical LCD featuring HID technology offers the advantage of local, real time information entry and presentation. The interactive graphical LCD display presents input configuration options status using a check mark, visual images such as an open door, numerical and text data, and indicators such as color specific square and circular shapes, LOGO configuration of image and text information, an output relay and inputs status monitoring screen, and a top level navigation screen.

The electric door lock and monitoring system's input active/inactive status for IN1, IN2, IN3, and IN4 is shown on the interactive graphical LCD display as green/blue circle per input respectively. The preferred embodiment of the electric door lock and monitoring system's output's active/inactive status for each of the four output relays is shown on the display as green/blue square per output respectively. Said differently, active status is indicated by a displayed color of green whereas inactive status is displayed as a color of blue for both the circle and square shapes that denote input and output active/inactive status respectively. Alternate embodiments of the electric door lock and monitoring system's input and output indicators may use a plurality of colors and shapes to indicate various status settings.

Interconnections include an electrical wiring connection between the iButton and the circuit board, an electrical wiring connection between the sounding device and the circuit board, an electrical wiring connection between the interactive graphical interface LCD display and the circuit board, an electrical wiring connection between the a iButton and the circuit board, an electrical wiring connection between the a Wiegand card reader and the circuit board, an electrical wiring connection between an electrified lock and the circuit board, and an electrical wiring connection between the sounding device and the circuit board.

Alternate embodiments of the electric door lock and monitoring system include arrangements such that the programmable microprocessor controller and display driver are combined into a single integrated circuit, the housing is embedded in a door Panic bar combination opening mechanism, and the programmable microprocessor controller controls and receives inputs from a plurality of external interactive graphical LCD display drivers and external interactive graphical LCD display driver connectors operating together in functional combination. The iButton LED has battery-less touch transmit and receive capability.

In alternate embodiments of the electric door lock and monitoring system, the sounding device can be a speaker, buzzer, piezo, or other electronic component capable of generating sound in the human hearing frequency range.

In alternate embodiments of the electric door lock and monitoring system, the input power source can be via Power over Ethernet (PoE) from the PoE connectors or via the +12V supply connector. Alternate embodiments include integrating the Wiegand card reader and iButton reader into a single component.

Referring now to FIG. 1 illustrating the electric door lock controller and monitoring system including an electric door lock controller and monitoring assembly having a housing comprising a plurality of mounting screw holes, a sounding device opening, a visual display opening, an IButton or Wiegand card reader assembly opening, and a plurality of circuit board mounting screw holes. The housing supports an interactive graphical LCD display having human interface (commonly known as HID) capability. The housing provides a mounting platform for supporting a sounding device, such as a speaker, an iButton assembly having a mounting bezel and an iButton including an iButton reader connector, power transmit capability, signal transmit capability, signal receive capability, and a multi colored LED. The housing also provides a mounting platform for supporting a Wiegand card reader assembly having a mounting bezel and a Wiegand card reader including a Wiegand card reader connector, power transmit capability, signal transmit capability, signal receive capability, and a multi colored LED. The iButton and Wiegand card reader provide access signaling capability through wireless electronic waveforms. The iButton provides power to activate a Fob that has a unique access code to enable access on a per user basis. The housing supports a circuit board with a plurality of circuit board mounting screws.

Figure 2:
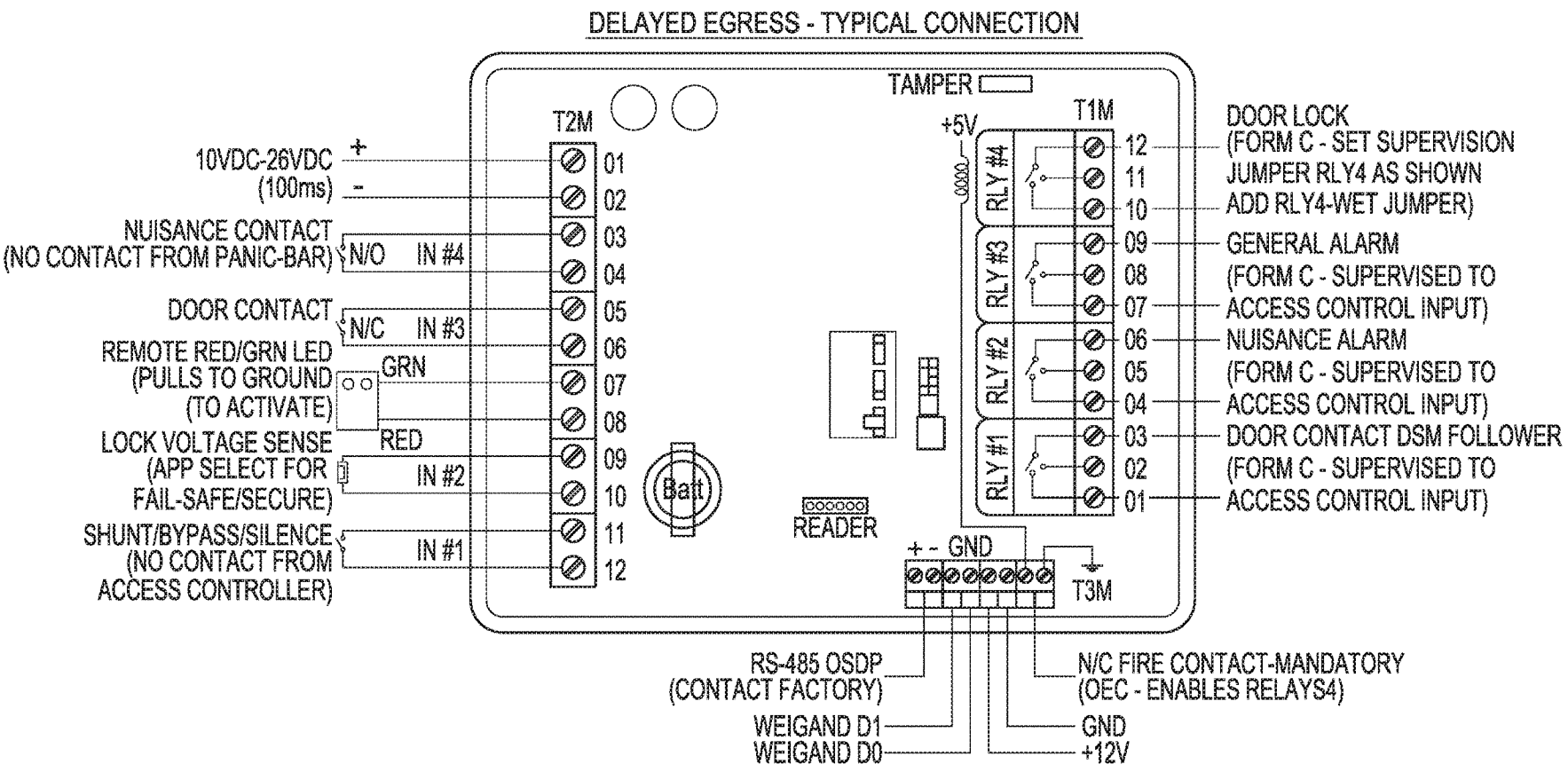
FIG. 2 is a schematic view of a Delayed Egress Typical Connection according to an embodiment of the present invention.

Referring now to FIG. 2 illustrating a Delayed Egress Typical Connection wiring between a remote monitoring and control station to the circuit board having an T2M input terminal including an INPUT1 input connector and an INPUT1 (IN #1 with terminals 11 and 12 respectively) return connector configured as a Shunt/Bypass/Silence control via a normally open (N/O) switch, an INPUT2 input connector and an INPUT2 return connector (IN #2 with terminals 09 and 10 respectively) configured as a lock voltage sense for sensing the door lock, an INPUT3 input connector n INPUT3 return connector (IN #3 with terminals 06 and 05 respectively) configured as a door contact via a normally closed (N/C) switch, an INPUT4 input connector and an INPUT4 return connector (IN #4 with terminals 04 and 03 respectively) configured as a nuisance contact from a panic bar via a normally open (N/O) switch, a RED_LED output, a GREEN_LED output signal, and DC positive input and an AC/DC return configured to accept DC input voltages in the range of 10-26 VDC.

The circuit board has a T1M output terminal connector including a RELAY1-NC connection, a RELAY1-NO connection, a RELAY1-COMM connection (RLY #1 with terminals 01, 02, and 03 respectively) configured as a door contact DSM follower; a RELAY2-NC connection, a RELAY2-NO connection, and a RELAY2-COMM connection (RLY #2 with terminals 04, 05, and 06 respectively) configured as a nuisance alarm; a RELAY3-NC connection, a RELAY3-NO connection, and a RELAY3-COMM connection (RLY #3 with terminals 07, 08, and 09 respectively) configured as a general alarm; and a RELAY4-NC connection, a RELAY4-NO connection, and a RELAY4-COMM connection (RLY #4 with terminals 10, 11, and 12 respectively) configured as a door lock with all output relays operated normally closed (N/C) manner.

The circuit board also has a T3M terminal connector including a first FIRE-IN connector, a second FIRE-IN connector (terminals 02, 01 respectively), a GROUND connector, a +12 Volt supply connector, a WIEGAND D0 connector, a WIEGAND D1 connector, an RS-485− connector, and an RS-485+ connector. The first FIRE-IN connector and the second FIRE-IN connector are configurable for microprocessor control as well as direct control free of microprocessor control in accordance with regulations such that fire alarm control remains during power outages. The WIEGAND D0 connector, and a WIEGAND D1 connector are for card reader access and are electrically connected to the Wiegand card reader. OSPD communication is via a wired connection to an RS-485− terminal and an RS-485+ terminal on connector T3M.

FIG. 2 further illustrates how standard industry settings are configured using an on-board End of Line (EOL) 1k and 1k/2k jumper selector that includes 1k and 2k resistors as an example for one of the four relays. FIG. 2 shows a READER connector that is wired to the iButton reader.

Figure 3:
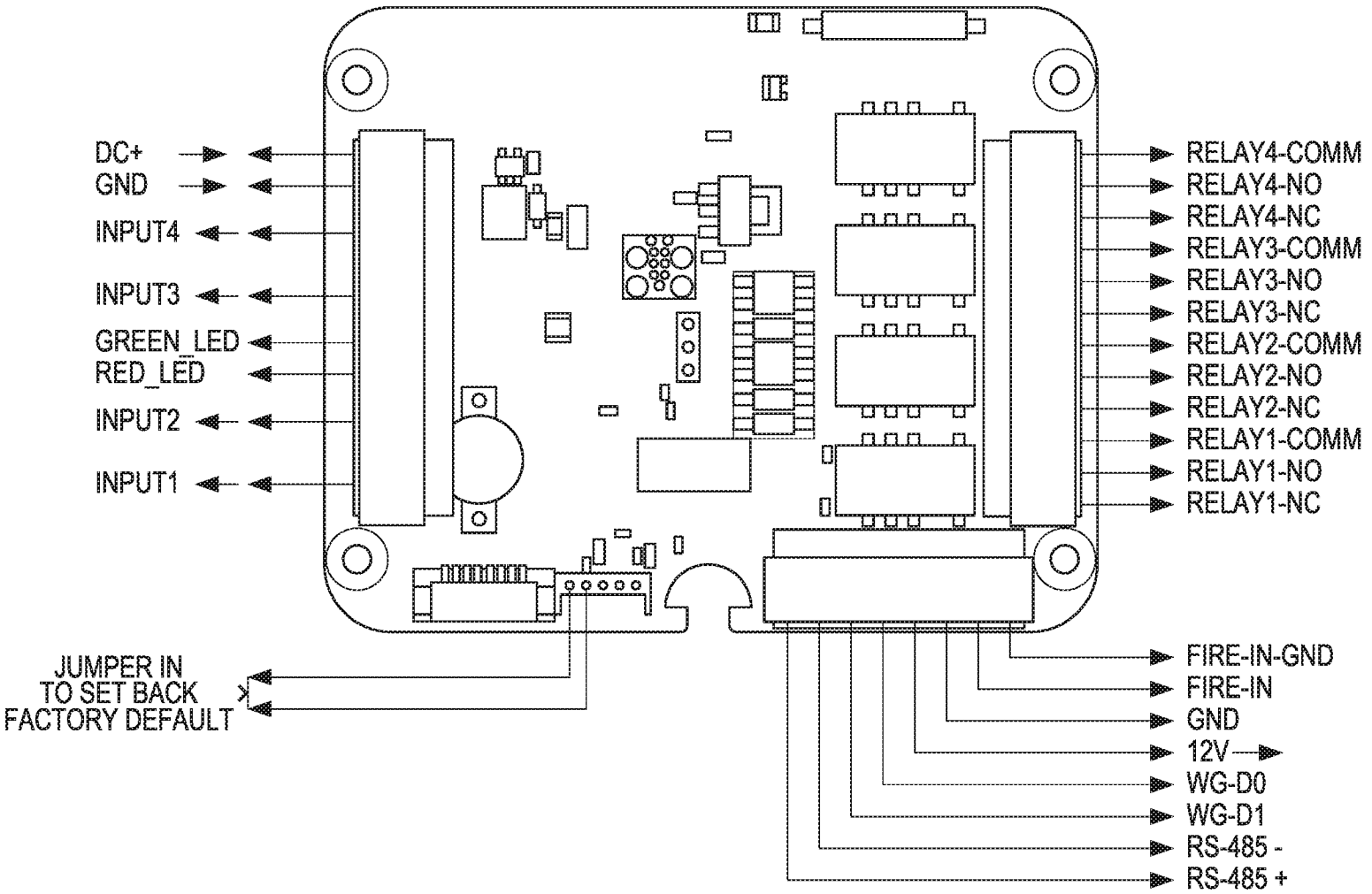
FIG. 3 is a schematic view of an electric door lock and monitoring system showing a circuit board according to an embodiment of the present invention.

Referring now to FIG. 3, the circuit board has a factory reset jumper selector, a TEMPER magnetic reed switch, a voltage regulator circuit for powering the programmable microprocessor controller (not shown in FIG. 3). The programmable microprocessor controller includes Bluetooth wireless signaling capability, an RS-485 bus connection, a proprietary software program having mobile App software interface capability, web page control and monitoring interface capability, and local programming interface capability including iButton reader control and signaling capability and Wiegand card reader capability, biometric identification sensor reading capability, and interactive graphical display LCD display input control and signaling capability. The circuit board has four programmable output relays, each having a built-in user selectable End of Line (EOL) supervision resistor kit comprising a 1k EOL supervisor resistor and a 2k EOL supervisor resistor that are user selected by jumper SEL1.

The circuit board has an interactive graphical interface LCD display driver, an interactive graphical interface LCD display connector, a reader connector, a battery, and a high precision clock/calendar circuit. The relay designated to activate the electromechanical door lock has a built in automatically resettable, solid state, digital circuit breaker and does not utilizes a mechanical fuse thus offering the advantage of automatic reset without requiring manual replacement of the fuse.

Figure 4A:
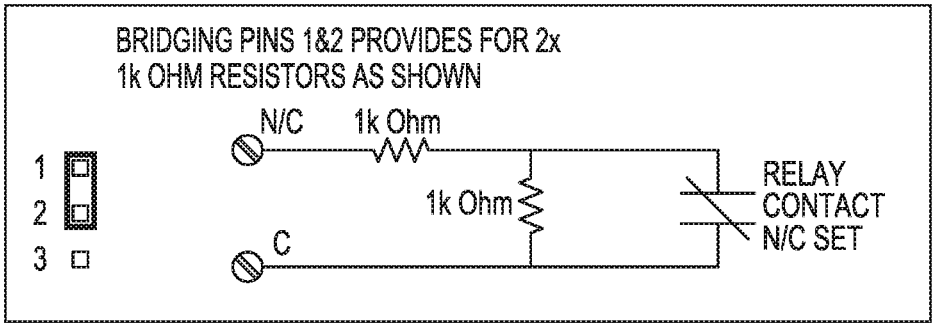
FIGS. 4*a*-4*c* illustrate three schematic views of an electric door lock and monitoring system showing the jumper settings for the on-board End of Line (EOL) 1k and 1k/2k jumper selectors according to an embodiment of the present invention.
Figure 4B:
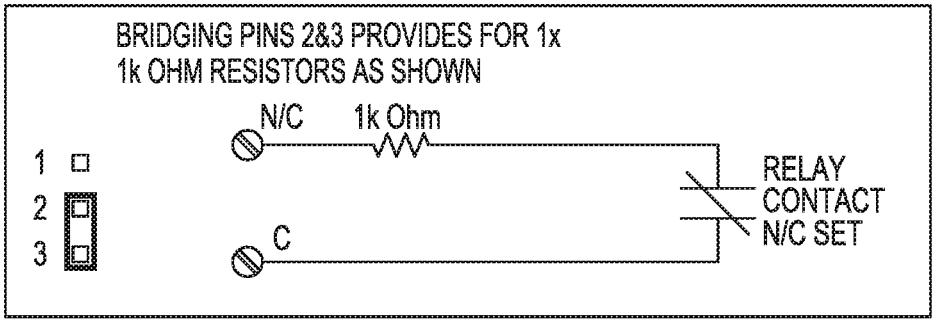
Figure 4C:
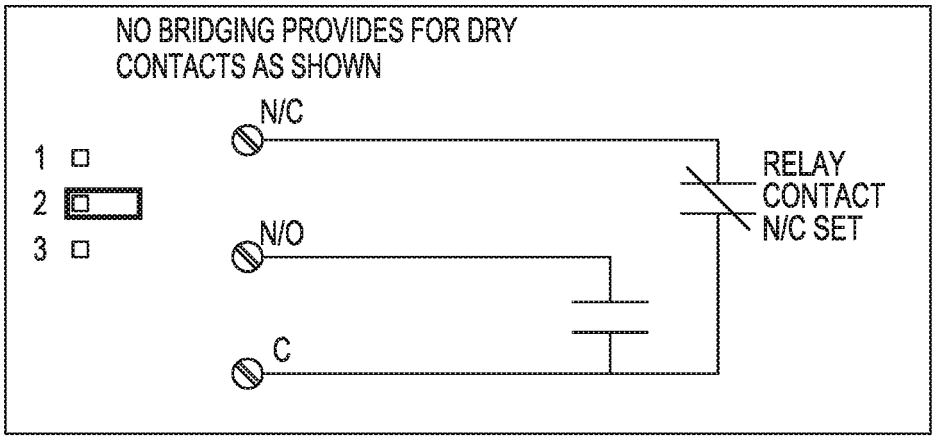

Referring now to FIGS. 4*a*-4*c* showing the jumper settings for the on-board End of Line (EOL) 1k and 1k/2k jumper selectors that includes 1k and 2k resistors. The three arrangements shown in FIGS. 4*a*-4*c* are an example for one of the four relays. Each relay End of Line (EOL) 1k and 1k/2k jumper selectors can be configured separately. FIG. 4*a* shows a jumper arrangement for 2×1k ohm resistance by bridging jumper pins 1 & 2. FIG. 4*b* shows a jumper arrangement for 1×1k ohm resistance by bridging jumper pins 2 & 3. FIG. 4*c* shows a jumper arrangement for dry contact by not bridging any of the jumper pins with a jumper connector.

Figure 5:
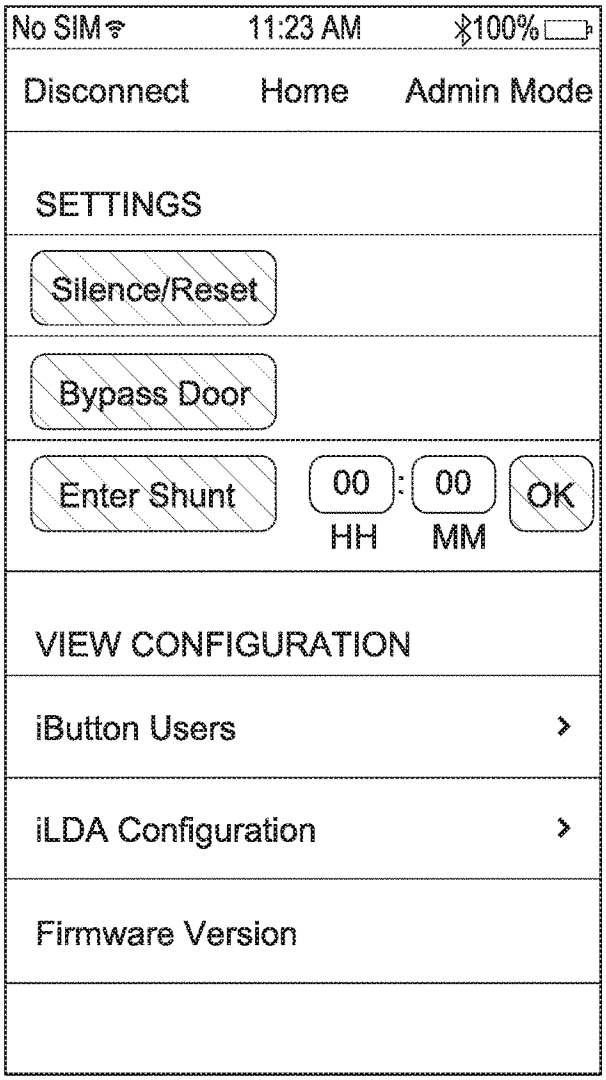
FIG. 5 is a screen shot of an electric door lock and monitoring system showing a home programming screen for initiating settings and viewing the configuration according to an embodiment of the present invention.

Referring now to FIG. 5, show is a home programming screen for initiating settings and viewing the configuration, the settings include establishing timing durations for Silence/Reset, Bypass Door, and Enter Shunt.

Figure 6:
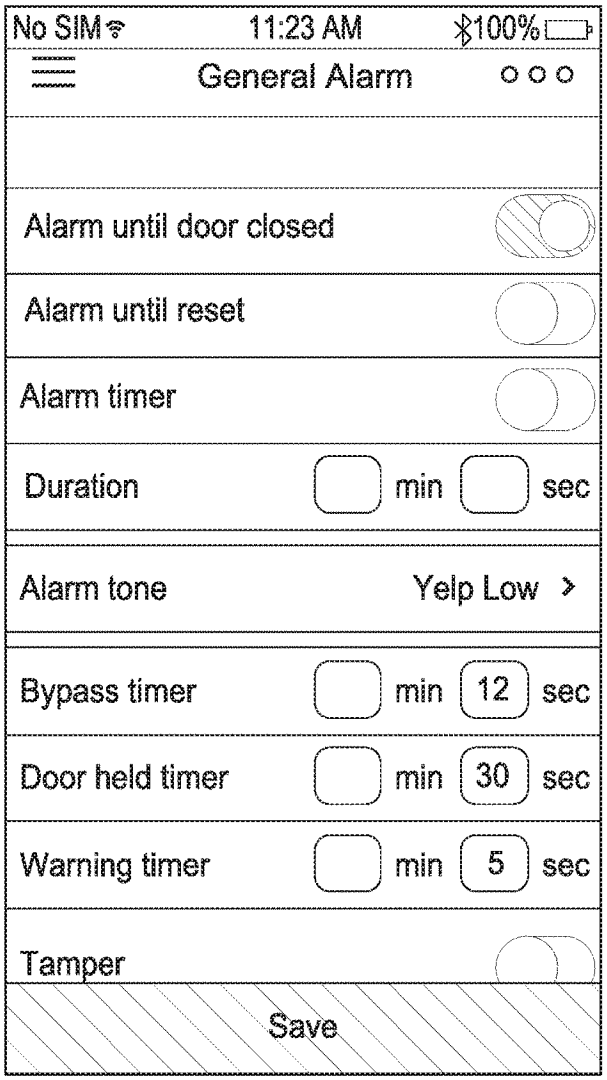
FIG. 6 is a screen shot of an electric door lock and monitoring system showing a general alarm programming screen for Alarm settings, timer settings, and Tamper status according to an embodiment of the present invention.

Referring now to FIG. 6, show is a general alarm programming screen for Alarm settings, timer settings, and Tamper the alarm settings are toggled on or off with a programmable alarm duration. Timer durations are selectable for the Bypass timer, Door held timer, and Warning timer that counts down the time that is initiated when a Push Bar is pressed.

Figure 7:
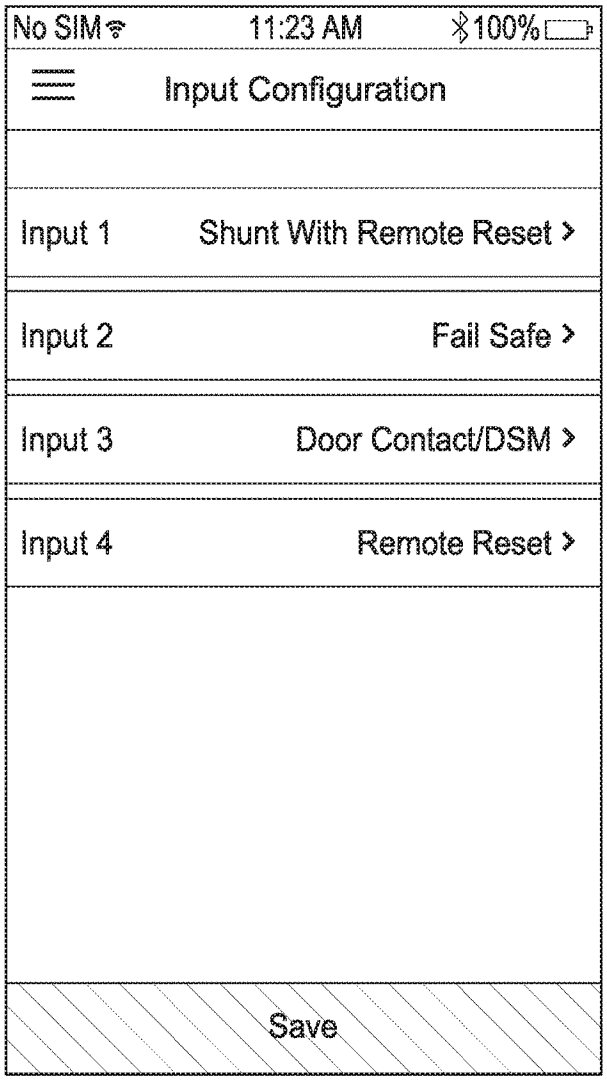
FIG. 7 is a screen shot of an electric door lock and monitoring system showing an input configuration programming screen for initializing inputs according to an embodiment of the present invention.

Referring now to FIG. 7, show is an input configuration programming screen for initializing inputs IN1, IN2, IN3, and IN4, several programming settings are shown.

Figure 8:
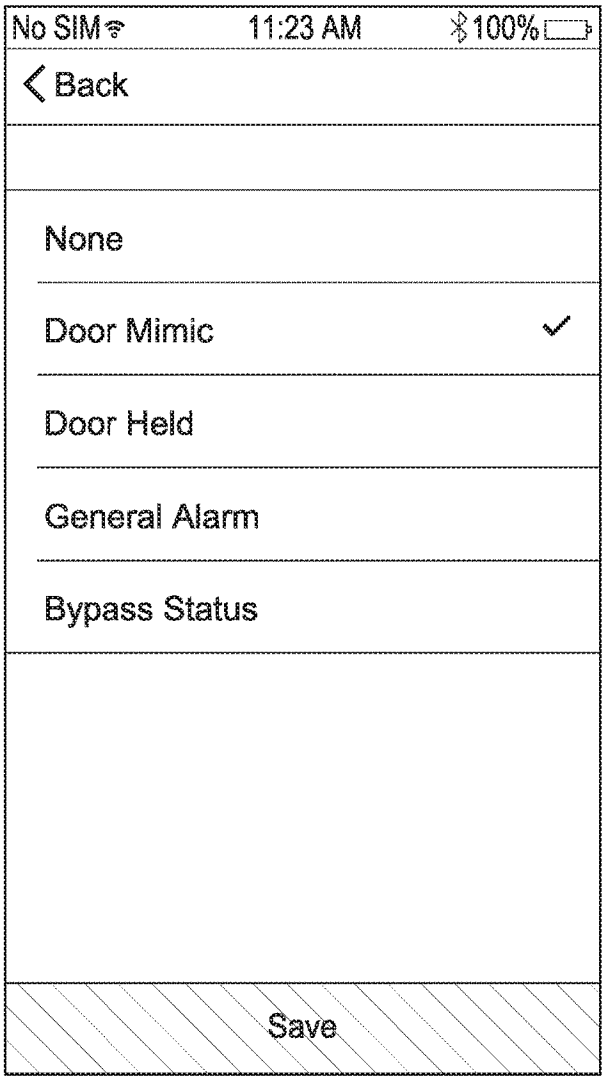
FIG. 8 is a screen shot of an electric door lock and monitoring system showing a general programming screen for initiating a door mimic setting according to an embodiment of the present invention.

Referring now to FIG. 8, show is a general programming screen for initiating a door mimic setting that replaces a door sensor that is normally affixed to the door jam and the door for notifying the user that the door is closed.

Figure 9:
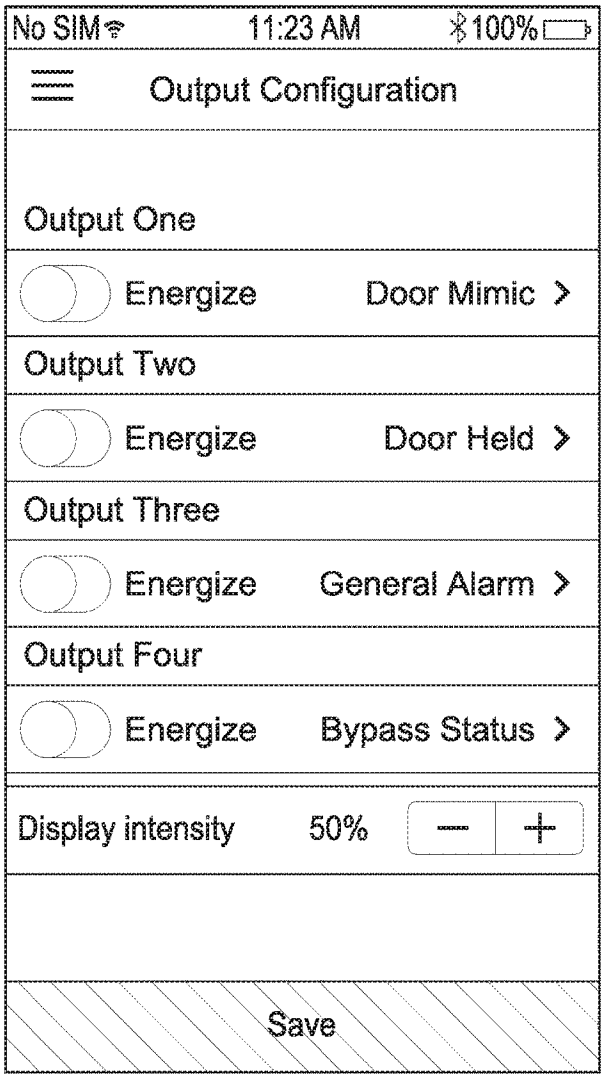
FIG. 9 is a screen shot of an electric door lock and monitoring system showing an Output Configuration programming screen for initiating the status of the four output relays according to an embodiment of the present invention.

Referring now to FIG. 9, show is an Output Configuration programming screen for initiating the status of the four output relays by choosing a toggle switch that energizes relays or leaves them unenergized. Also shown is the ability to control the Display intensity of the interactive graphical LCD display.

Figure 10:
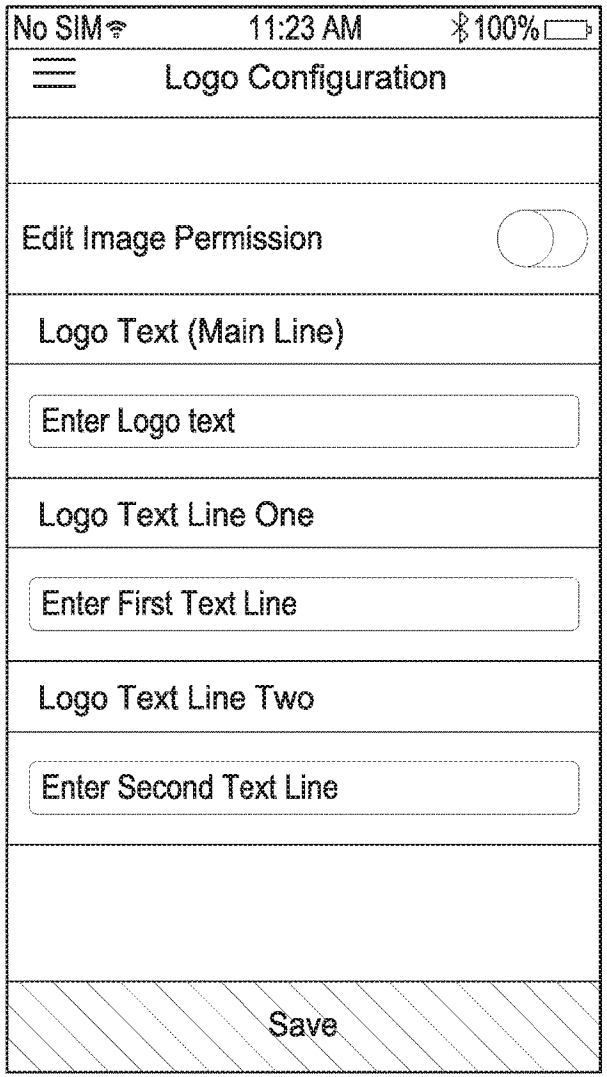
FIG. 10 is a screen shot of an electric door lock and monitoring system showing a Logo Configuration programming screen according to an embodiment of the present invention.

Referring now to FIG. 10, show is a Logo Configuration programming screen for adding a background logo image, a main text line, a Text Line One, and a Text Line 2 for a screen presented on the interactive graphical LCD display.

Figure 11:
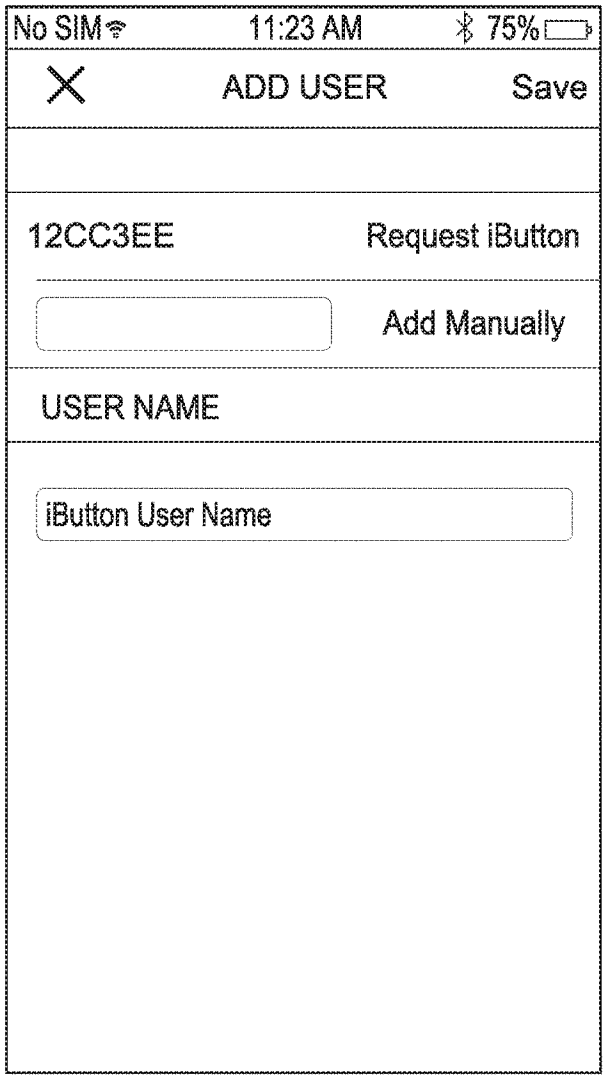
FIG. 11 is a screen shot of an electric door lock and monitoring system showing an Add User programming screen according to an embodiment of the present invention.

Referring now to FIG. 11, show is an Add User programming screen for one of the 150 users stored in the database that manages user's access rights options are illustrated for adding a user manually or via an iButton signal from an iButton request command line.

Figure 12:
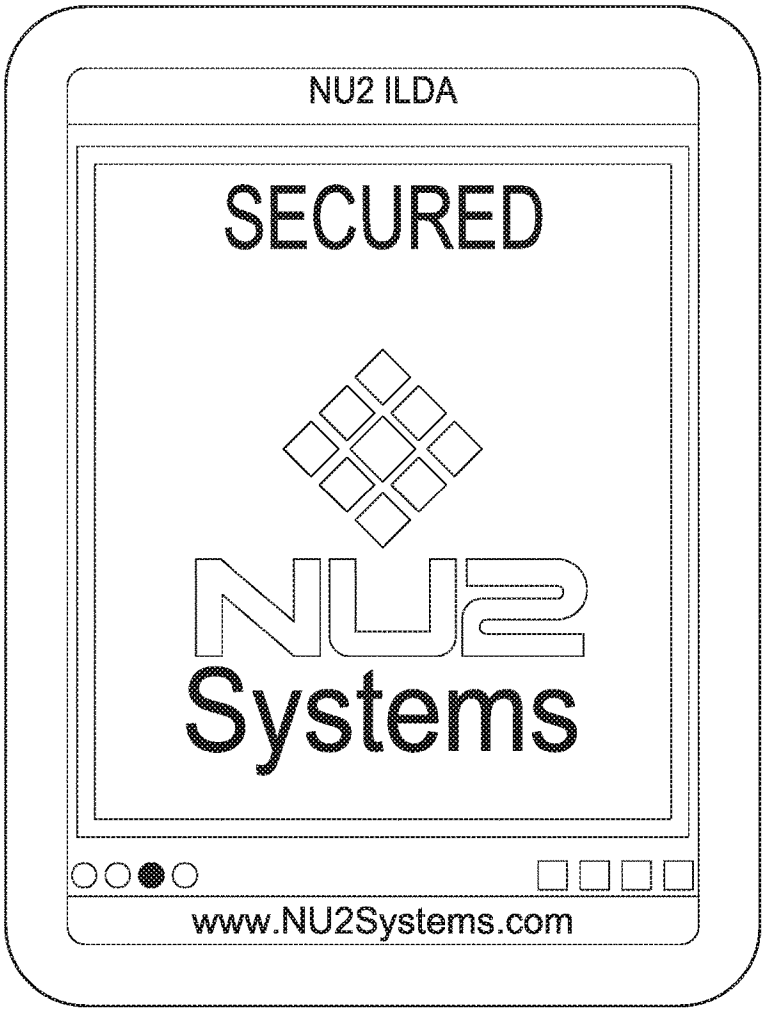
FIG. 12 is a perspective view of an electric door lock and monitoring system showing a top level monitoring screen indicating the door is secured and in idle mode according to an embodiment of the present invention.

Referring now to FIG. 12, show is a top level monitoring screen indicating the door is secured and in idle mode. A default logo is shown. In default mode, the user can enter up to two custom text lines as needed. Text line locations include header text at the top of the screen, footer text at the bottom of the screen, and text in the middle of the screen. Also shown are four circles whose green or blue color indicates active or inactive status for the four inputs respectively and four squares whose green or blue color indicates active or inactive status for the four outputs respectively.

Figure 13:
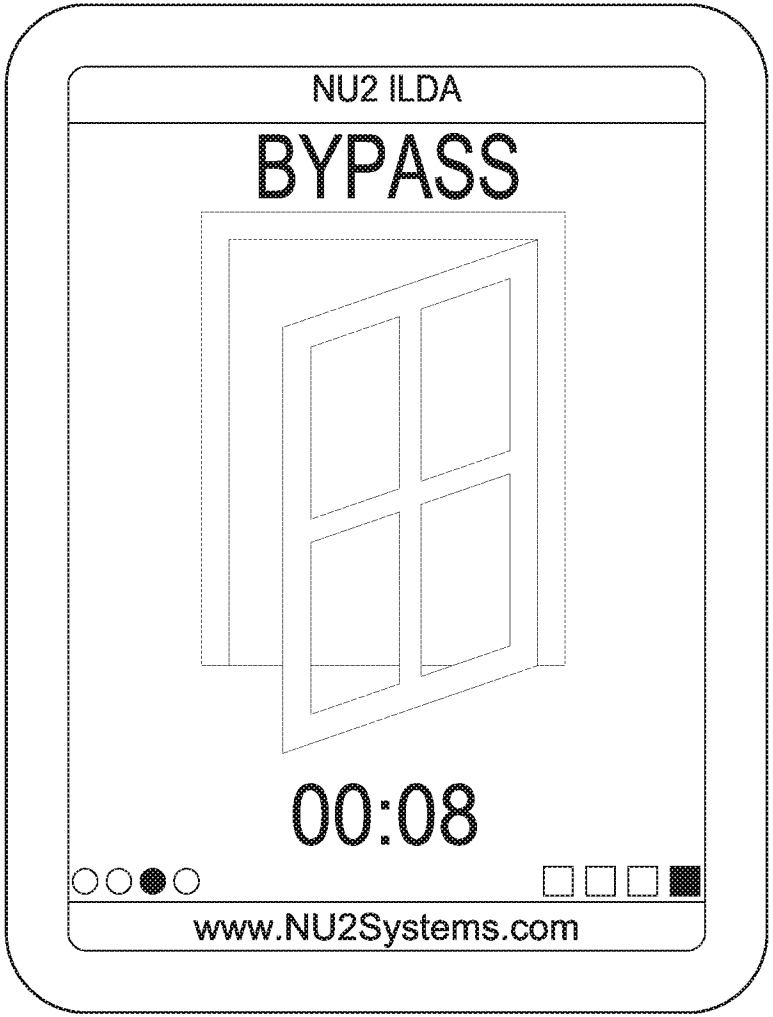
FIG. 13 is a perspective view of an electric door lock and monitoring system showing a monitoring screen indicating authorized exit mode according to an embodiment of the present invention.

Referring now to FIG. 13, show is a monitoring screen indicating authorized exit mode where the door alarm is bypassed while displaying timer countdown before entering pre-alarm mode the interactive graphical LCD display provides the observer Bypass status information.

Figure 14:
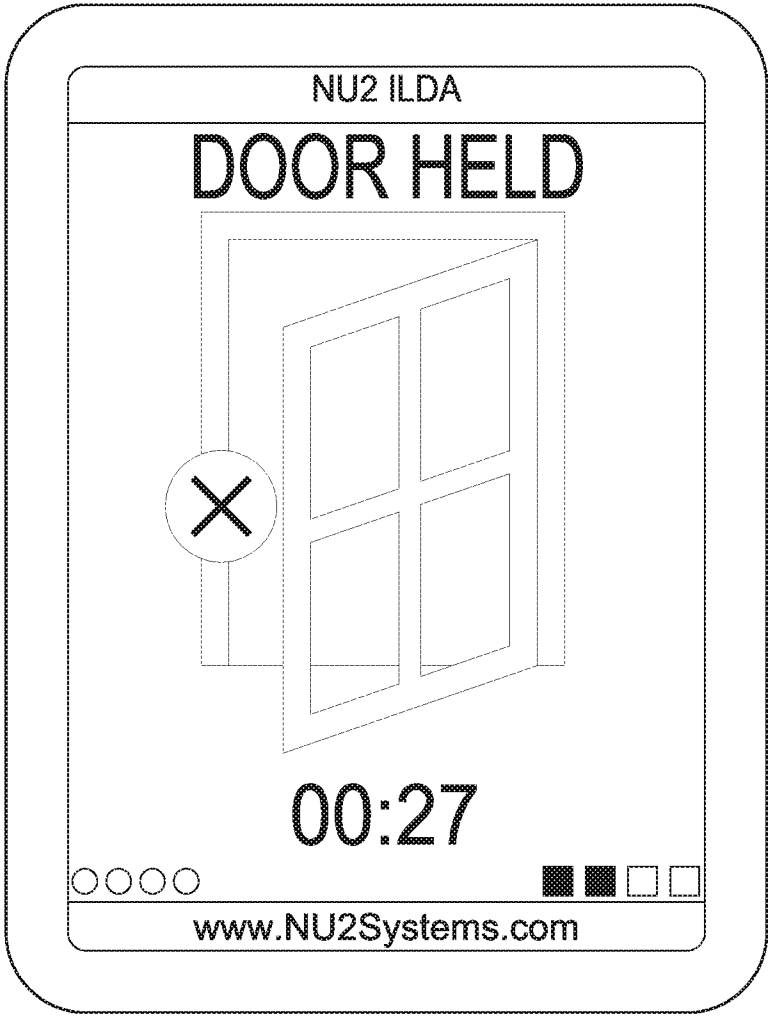
FIG. 14 is a perspective view of an electric door lock and monitoring system showing a monitoring screen indicating the door is being held open according to an embodiment of the present invention.

Referring now to FIG. 14, show is a monitoring screen indicating the door is being held open while displaying the timer countdown before entering pre-general alarm mode, the interactive graphical LCD display provides the user with Door Held and time held information.

Figure 15:
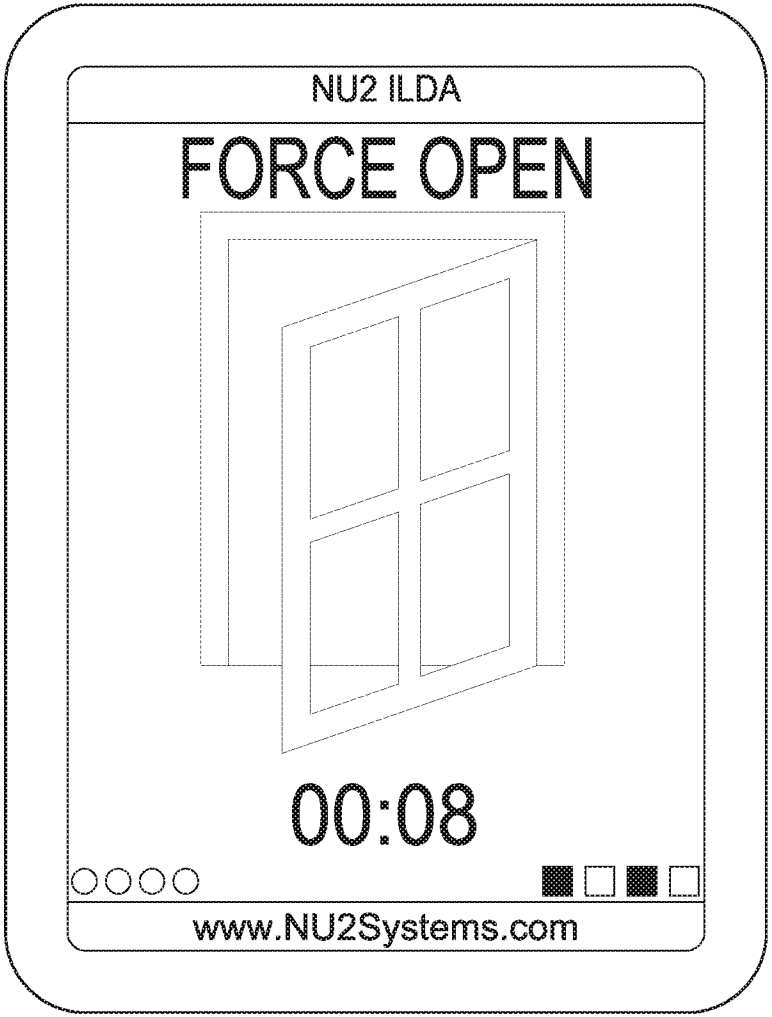
FIG. 15 is a perspective view of an electric door lock and monitoring system showing a monitoring screen indicating the door is in alarm according to an embodiment of the present invention.

Referring now to FIG. 15, show is a monitoring screen indicating the door is in alarm due to being forced open while displaying accumulated time in the alarm mode the interactive graphical LCD display presents Force Open information.

Figure 16:
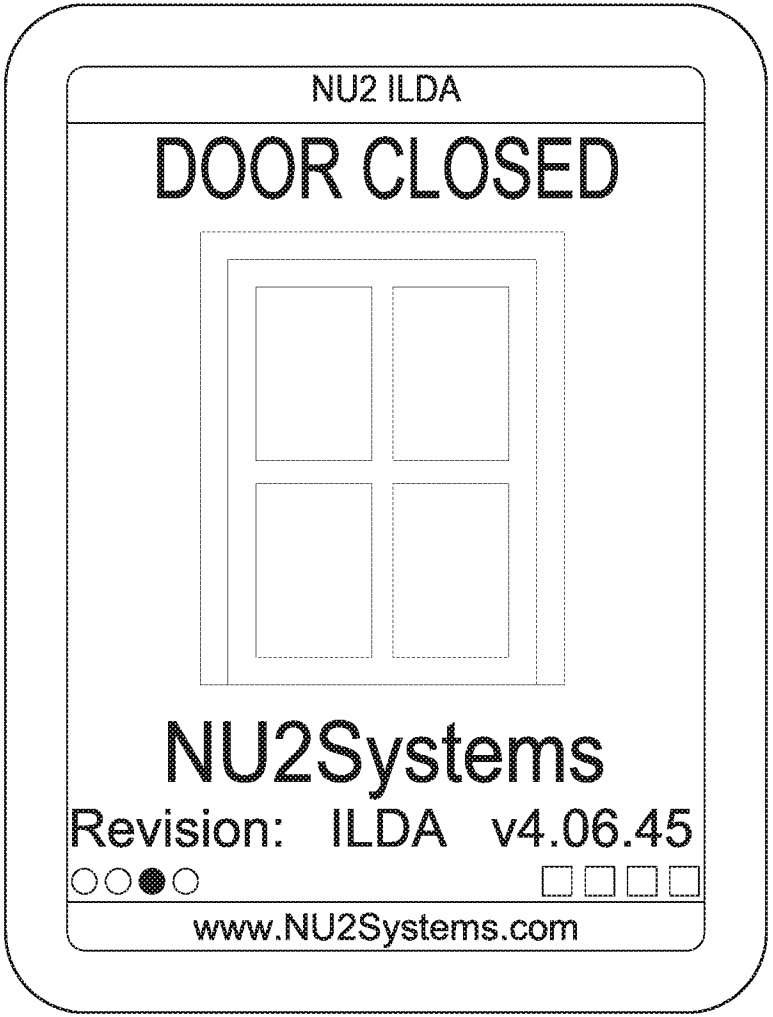
FIG. 16 is a perspective view of an electric door lock and monitoring system showing a monitoring screen indicating the door is closed according to an embodiment of the present invention.

Referring now to FIG. 16, show is a monitoring screen indicating the door is closed and about to enter the idle/secure condition interactive graphical LCD display presents Door Closed status during an idled condition.

Figure 17:
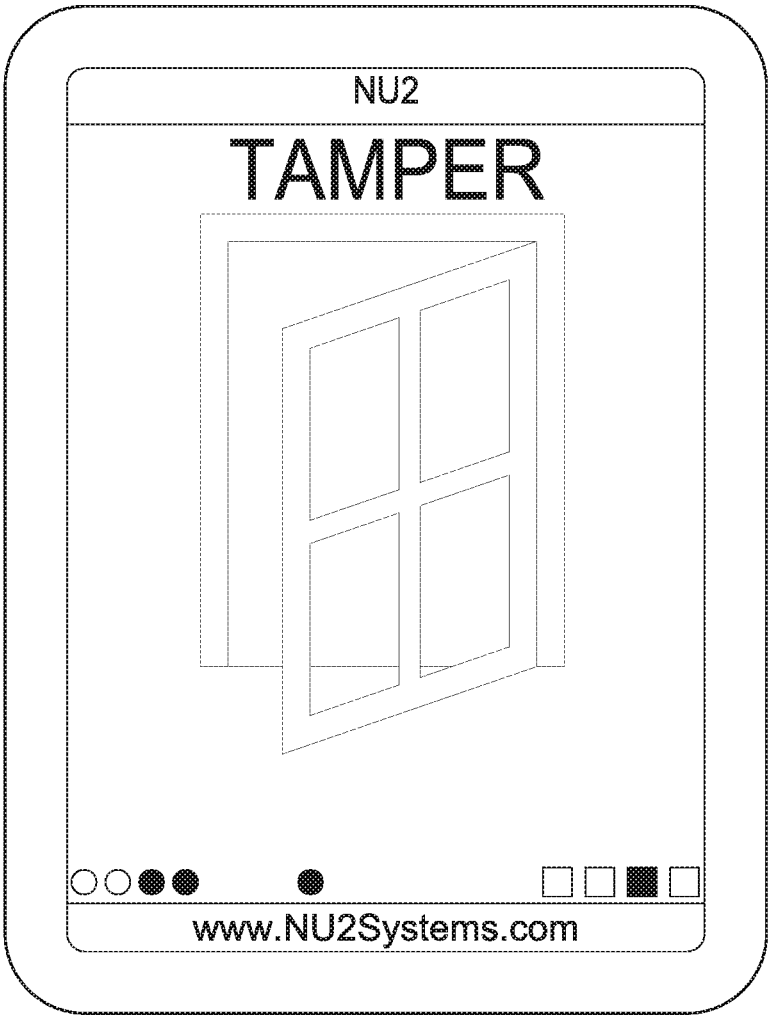
FIG. 17 is a perspective view of an electric door lock and monitoring system showing a monitoring screen indicating a Tamper status condition according to an embodiment of the present invention.

Referring now to FIG. 17, show is a monitoring screen indicating a Tamper condition where the housing has been moved out of position with the Tamper sensor.

Figure 18:
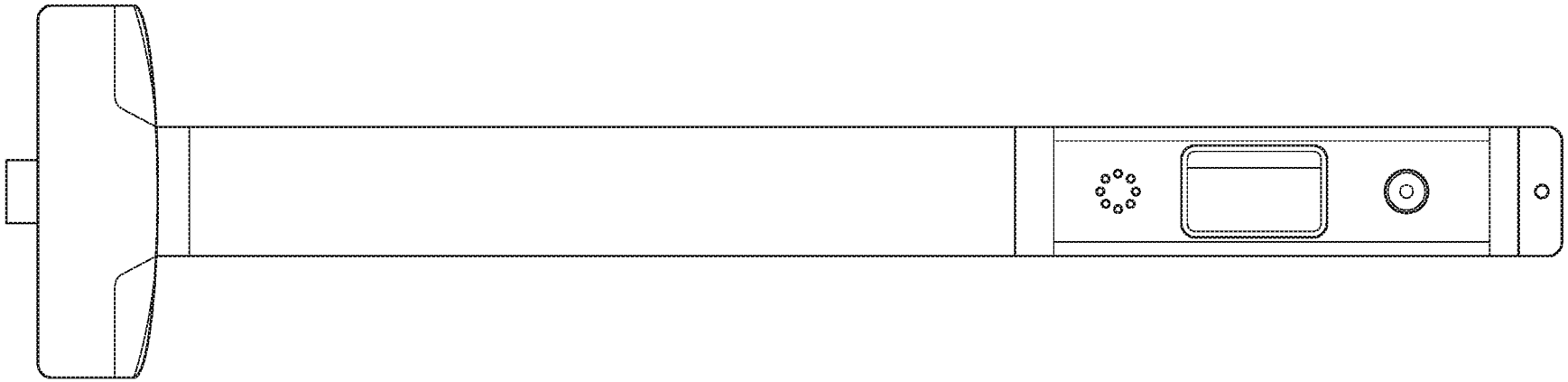
FIG. 18 is a perspective view of an electric door lock and monitoring system showing an alternate embodiment of the electric door lock and monitoring system having a housing that is included in a door push bar.

Referring now to FIG. 18, show is an alternate embodiment of the electric door lock and monitoring system having a housing that is included in a door Push Bar with examples of various types of monitoring screens.

Figure 19:
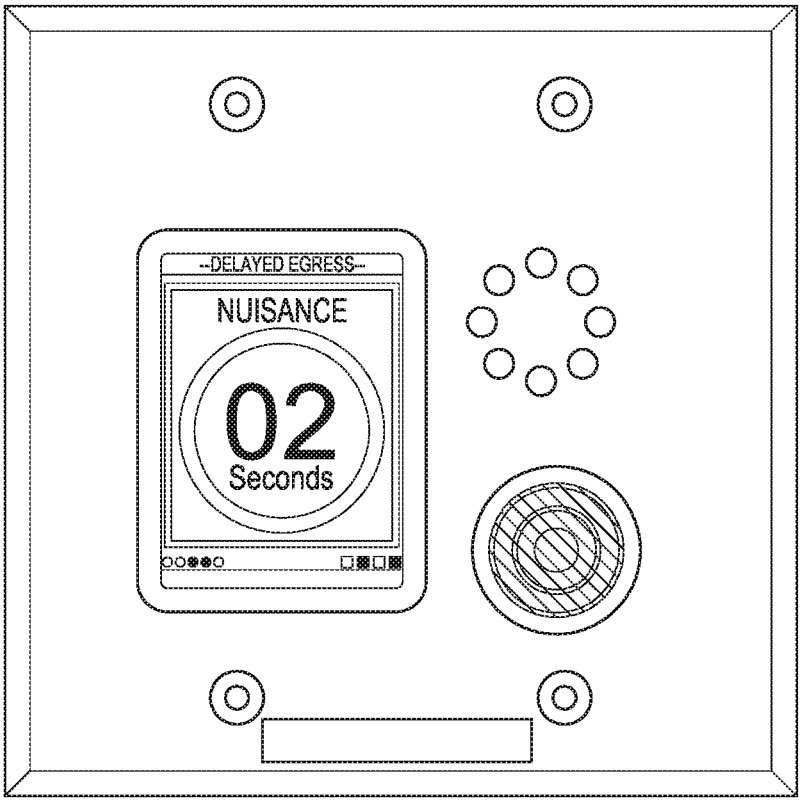
FIG. 19 is a perspective view of an electric door lock and monitoring system showing a top level monitoring screen indicating a nuisance alarm with delayed egress time in seconds according to an embodiment of the present invention.

Referring now to FIG. 19, show is a top level monitoring screen indicating a nuisance alarm with delayed egress time in seconds the interactive graphical LCD display presents Nuisance alarm, as well as input and output status, as colored circles and dots collectively.

Figure 20:
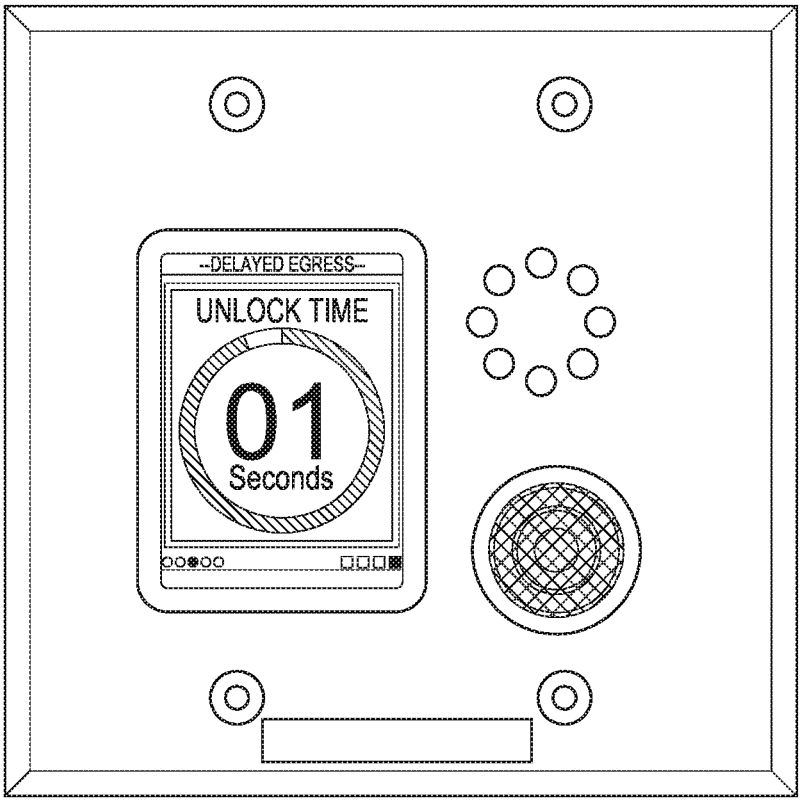
FIG. 20 is a perspective view of an electric door lock and monitoring system showing the electric door lock system displaying a top level monitoring screen indicating a delayed egress unlock time in seconds according to an embodiment of the present invention

Referring now to FIG. 20, show is a preferred embodiment of the electric door lock system displaying a top level monitoring screen indicating a delayed egress unlock time in seconds with an outer ring consisting of red and green colors in proportion to the remaining time. Alternate embodiments of the electric door lock system and method may use different color schemes for the outer ring.

A method of use for the electric door lock and monitoring system includes installing the electrified electric door lock controller and monitoring system, connecting signal, power, and load wires to the electrified electric door lock controller and monitoring system. applying power to the electrified electric door lock controller and monitoring system, setting the manual selections via DIP switch and jumper positioning, programming the electric door lock controller and monitoring system via a software interface, and monitoring and control of the electric door lock controller and monitoring system.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

What is claimed is:

1. A monitoring and control system for an electric door lock, the system comprising:

a processor controlling operation of the electronic door lock;

a memory in communication with the processor, the memory having stored thereon location-based rules data;

a graphical interface in communication with the processor, the graphical interface visually displaying information relating to operation of the electronic door lock;

a user interface in communication with the processor, the user interface adapted to receive data from a user device;

a wireless access device reader in communication with the processor, the wireless access device reader adapted to detect the presence of a wireless access device and transmit data indicative thereof to the processor;

a speaker in communication with the processor, the processor causing the speaker to generate audible alarms in at least some situations, the audible alarms comprising spoken word alarms in at least one language;

wherein the processor controls the electronic door lock at least in part based on a selected subset of the location-based rules data, the subset of location-based rules data being automatically selected by the processor at least in part based on data indicative of a geographic location of the electronic door lock;

wherein the spoken word alarms increase in frequency and/or in sound pitch over time to portray increased urgency; and wherein the spoken word alarm comprises a countdown toward zero, and wherein the spoken word alarm increases in frequency and/or in sound pitch as the countdown approaches zero to portray increased urgency.

2. The monitoring and control system of claim 1 further comprising a global positioning system (GPS) sensor in communication with the processor, the GPS sensor generating the data indicative of the geographic location of the electronic door lock.

3. The monitoring and control system of claim 1 wherein the user device comprises global positioning system (GPS) functionality, and wherein the data indicative of the geographic location of the electronic door lock is received from the user device by the user interface.

4. The monitoring and control system of claim 1 wherein the graphical interface comprises a liquid crystal display (LCD) mounted adjacent a door associated with the electronic door lock.

5. The monitoring and control system of claim 1 wherein the graphical interface comprises a liquid crystal display (LCD) mounted on a panic bar of a door associated with the electronic door lock.

6. The monitoring and control system of claim 1 wherein the user interface comprises a WiFi interface or a Bluetooth interface, and wherein the user device comprises a mobile device.

7. The monitoring and control system of claim 1 wherein the wireless access device reader comprises at least one of the following: a key fob reader, an iButton touch and hold reader and Wiegand wireless card reader.

8. A monitoring and control system for an electric door lock, the system comprising:

a processor controlling operation of the electronic door lock;

a memory in communication with the processor, the memory having stored thereon location-based rules data;

a graphical interface in communication with the processor, the graphical interface visually displaying information relating to operation of the electronic door lock;

a user interface in communication with the processor, the user interface adapted to receive data from a user device;

a wireless access device reader in communication with the processor, the wireless access device reader adapted to detect the presence of a wireless access device and transmit data indicative thereof to the processor;

wherein the processor controls the electronic door lock at least in part based on a selected subset of the location-based rules data, the subset of location-based rules data being automatically selected by the processor at least in part based on data indicative of a geographic location of the electronic door lock;

a speaker in communication with the processor, the processor causing the speaker to generate audible alarms in at least some situations, the audible alarms comprising spoken word alarms in at least one language; and wherein the spoken word alarms increase in frequency and/or in sound pitch over time to portray increased urgency; and wherein the spoken word alarm comprises a countdown toward zero, and wherein the spoken word alarm increases in frequency and/or in sound pitch as the countdown approaches zero to portray increased urgency.

9. The monitoring and control system of claim 8 further comprising a global positioning system (GPS) sensor in communication with the processor, the GPS sensor generating the data indicative of the geographic location of the electronic door lock.

10. The monitoring and control system of claim 8 wherein the user device comprises global positioning system (GPS) functionality, and wherein the data indicative of the geographic location of the electronic door lock is received from the user device by the user interface.

11. A monitoring and control system for an electric door lock, the system comprising:

a processor controlling operation of the electronic door lock;

a graphical interface in communication with the processor, the graphical interface visually displaying information relating to operation of the electronic door lock;

a user interface in communication with the processor, the user interface adapted to receive data from a user device;

a wireless access device reader in communication with the processor, the wireless access device reader adapted to detect the presence of a wireless access device and transmit data indicative thereof to the processor;

a speaker in communication with the processor, the processor causing the speaker to generate audible alarms in at least some situations, the audible alarms comprising spoken word alarms in at least one language;

wherein the spoken word alarms increase in frequency and/or in sound pitch over time to portray increased urgency; and wherein the spoken word alarm comprises a countdown toward zero, and wherein the spoken word alarm increases in frequency and/or in sound pitch as the countdown approaches zero to portray increased urgency.

12. The monitoring and control system of claim 11 further comprising:

a memory in communication with the processor, the memory having stored thereon location-based rules data; and wherein the processor controls the electronic door lock at least in part based on a selected subset of the location-based rules data, the subset of location-based rules data being automatically selected by the processor at least in part based on data indicative of a geographic location of the electronic door lock.

13. The monitoring and control system of claim 12 further comprising a global positioning system (GPS) sensor in communication with the processor, the GPS sensor generating the data indicative of the geographic location of the electronic door lock.

14. The monitoring and control system of claim 12 wherein the user device comprises global positioning system (GPS) functionality, and wherein the data indicative of the geographic location of the electronic door lock is received from the user device by the user interface.

* * * * *